US010687623B1

(12) United States Patent
Mello

(10) Patent No.: US 10,687,623 B1
(45) Date of Patent: Jun. 23, 2020

(54) FURNITURE SPACING SHELF ASSEMBLY

(71) Applicant: Ann-Marie Mello, Whitman, MA (US)

(72) Inventor: Ann-Marie Mello, Whitman, MA (US)

( * ) Notice: Subject to any disclaimer, the term of this patent is extended or adjusted under 35 U.S.C. 154(b) by 0 days.

(21) Appl. No.: 16/274,312

(22) Filed: Feb. 13, 2019

(51) Int. Cl.
*A47B 96/02* (2006.01)
*A47B 55/00* (2006.01)
*A47B 96/06* (2006.01)

(52) U.S. Cl.
CPC ..... *A47B 96/022* (2013.01); *A47B 55/00* (2013.01); *A47B 96/024* (2013.01); *A47B 96/068* (2013.01); *A47B 2220/0005* (2013.01); *A47B 2220/0036* (2013.01)

(58) Field of Classification Search
CPC ... A47B 96/022; A47B 96/024; A47B 96/068; A47B 55/00; A47B 2200/0005; A47B 2200/0036
USPC ..... 108/108, 50.02; 312/245, 223.6
See application file for complete search history.

(56) References Cited

U.S. PATENT DOCUMENTS 1,657,049 A * 1/1928 Van Sicklen, Jr. .... A47G 29/06 224/543
3,363,867 A * 1/1968 Zackrisson ..... A47B 57/18 248/250
3,432,134 A * 3/1969 Forschmidt ..... A47B 57/52 248/235
3,470,352 A 9/1969 McKay
3,837,605 A * 9/1974 Sicard ..... A47B 96/061 248/235
4,460,147 A * 7/1984 Macbain ..... F16B 12/22 248/222.41
4,720,069 A * 1/1988 Bessinger ..... A47B 96/061 211/90.01
4,734,826 A * 3/1988 Wilson ..... A47B 21/06 361/729
4,792,881 A * 12/1988 Wilson ..... A47B 21/06 312/223.6
4,793,267 A 12/1988 Birillo
4,829,653 A * 5/1989 Stich ..... F25D 23/04 29/458
4,936,467 A 6/1990 Bobeczko
5,269,095 A * 12/1993 Helfman ..... A47G 7/044 47/39
5,368,267 A * 11/1994 Howard ..... A47G 7/044 248/208
5,799,921 A 9/1998 Stattel
5,964,618 A * 10/1999 McCarthy ..... H01R 13/6666 439/535
6,691,964 B1 * 2/2004 Schaefer ..... A47B 96/061 108/108

(Continued)

*Primary Examiner* — Daniel J Troy
*Assistant Examiner* — Timothy M Ayres

(57) ABSTRACT

A furniture spacing shelf assembly for keeping an article of furniture from covering a heating vent includes a bracket that is attached to a vertical support surface. A box is removably attached to the bracket and the box has a depth of at least 4.0 inches. In this way the box can keep an article of furniture that is placed against the box from covering a heating vent that is positioned adjacent to the vertical support surface. A lid is hingedly coupled to the box for opening and closing the box. A power unit is coupled to the box and the power unit has a plurality of outlets therein. Each of the outlets can have an electronic device electrically coupled thereto for charging the electronic device.

4 Claims, 3 Drawing Sheets

(56) References Cited

U.S. PATENT DOCUMENTS

| | | | | |
|---|---|---|---|---|
| 8,051,783 | B1 * | 11/2011 | Hoskinson | A47B 37/00 108/23 |
| 8,082,859 | B2 * | 12/2011 | Sevack | A47B 96/066 108/152 |
| 8,430,252 | B2 | 4/2013 | Susan | |
| D718,556 | S | 12/2014 | Kreuzer | |
| 9,163,415 | B2 * | 10/2015 | Nies | A47B 96/061 |
| 9,185,979 | B1 * | 11/2015 | Jenks | A47B 96/066 |
| 9,578,961 | B1 * | 2/2017 | Johnson | A47B 21/06 |
| 2008/0047914 | A1 | 2/2008 | Young | |
| 2009/0224119 | A1 * | 9/2009 | Heffernan | A47B 96/066 248/225.11 |
| 2011/0109211 | A1 * | 5/2011 | Kirkeby | A47B 81/00 312/223.6 |
| 2013/0305964 | A1 | 11/2013 | Swallow | |

* cited by examiner

FURNITURE SPACING SHELF ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to furniture spacing devices and more particularly pertains to a new furniture spacing device for keeping an article of furniture from covering a heating vent.

BRIEF SUMMARY OF THE INVENTION

An embodiment of the disclosure meets the needs presented above by generally comprising a bracket that is attached to a vertical support surface. A box is removably attached to the bracket and the box has a depth of at least 4.0 inches. In this way the box can keep an article of furniture that is placed against the box from covering a heating vent that is positioned adjacent to the vertical support surface. A lid is hingedly coupled to the box for opening and closing the box. A power unit is coupled to the box and the power unit has a plurality of outlets therein. Each of the outlets can have an electronic device electrically coupled thereto for charging the electronic device.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
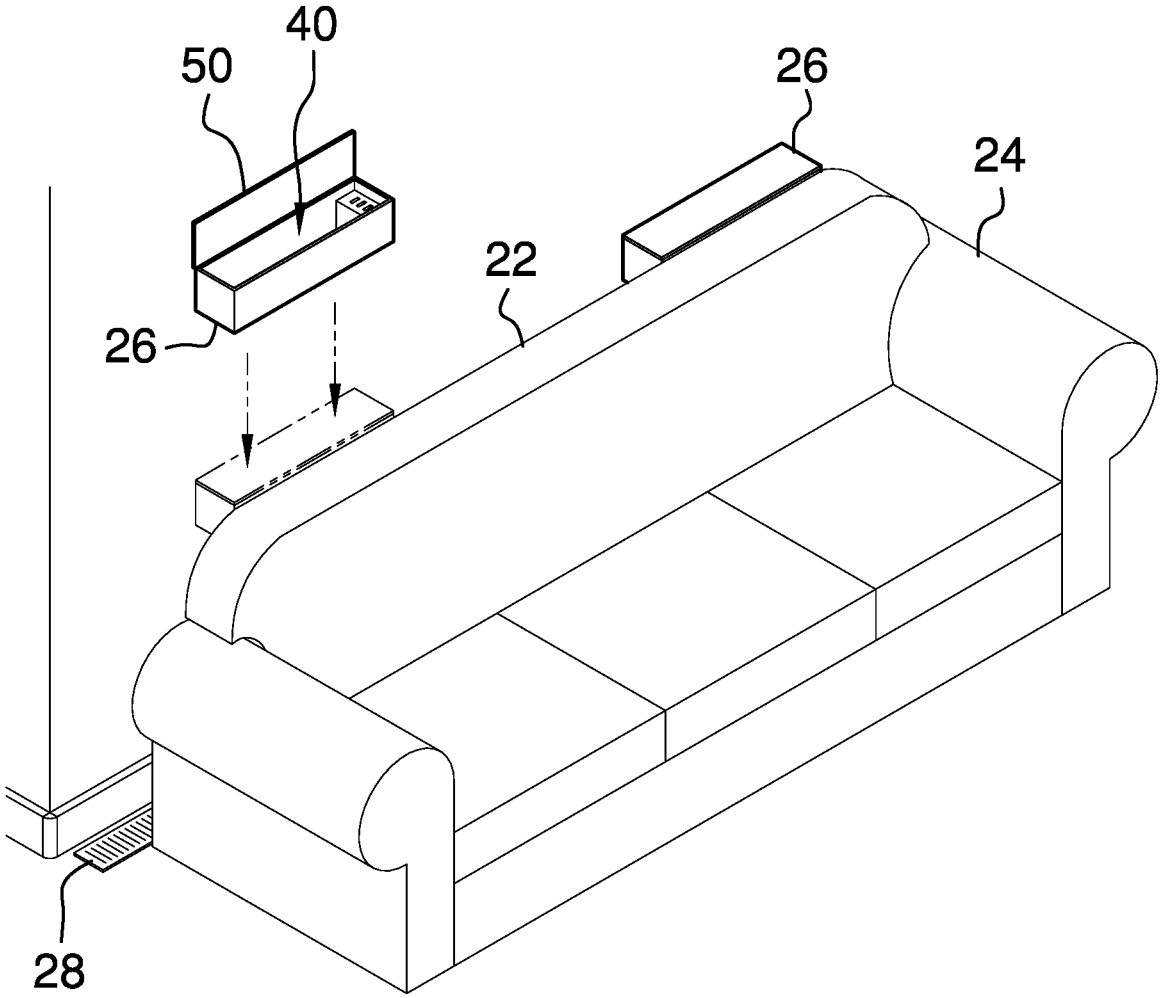
FIG. 1 is a perspective in-use view of a furniture spacing shelf assembly according to an embodiment of the disclosure.
Figure 2:
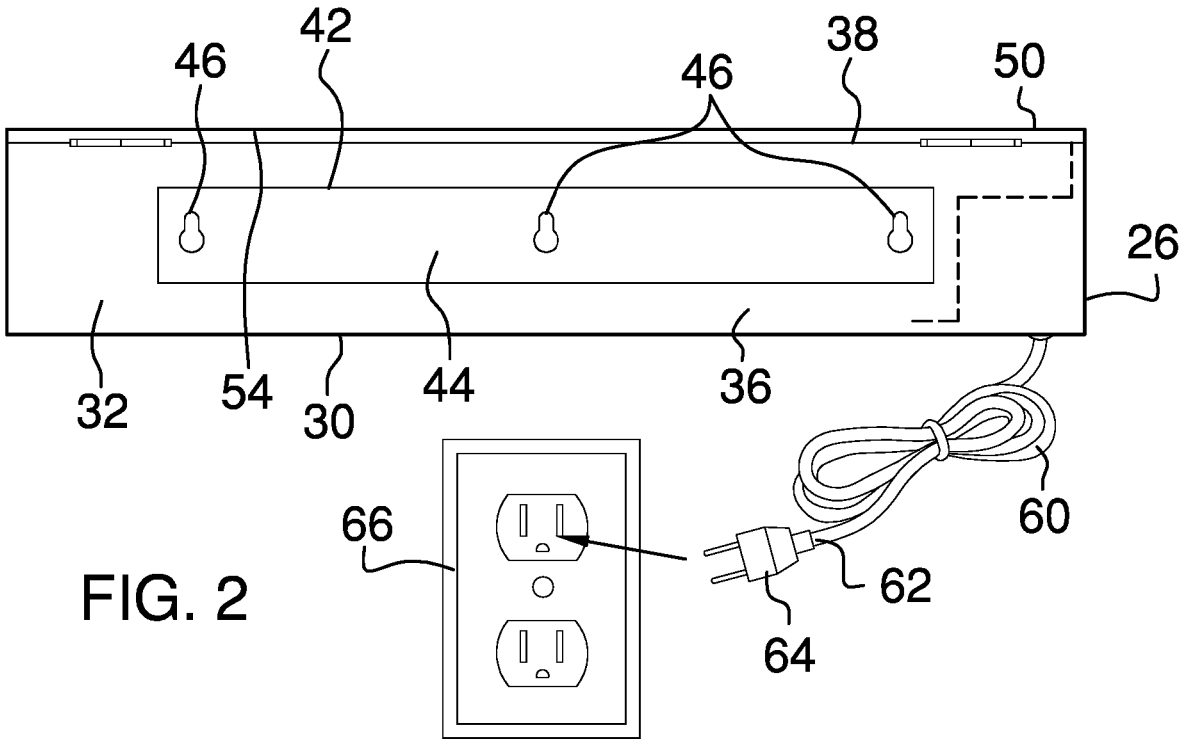
FIG. 2 is a back view of a box of an embodiment of the disclosure.
Figure 3:
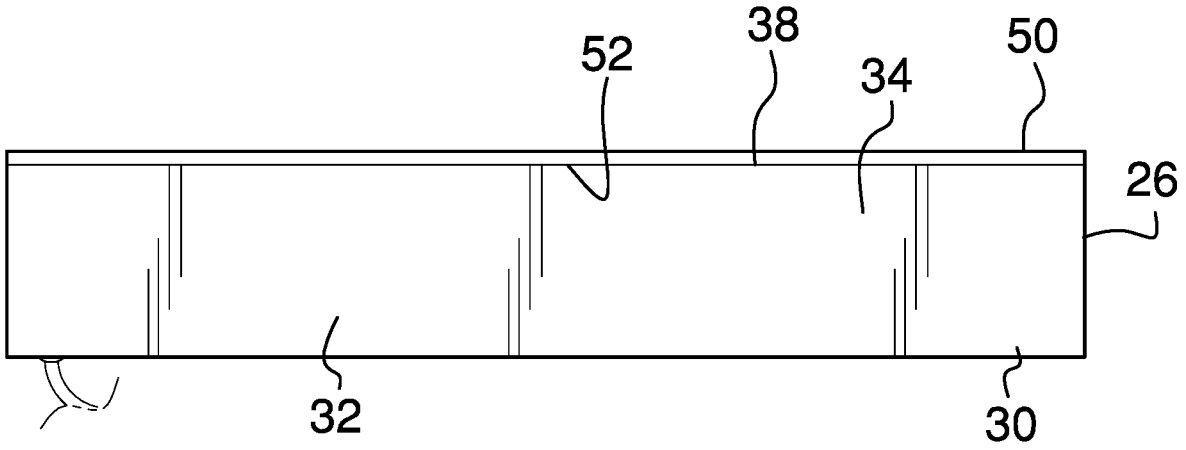
FIG. 3 is a front view of a box of an embodiment of the disclosure.
Figure 4:
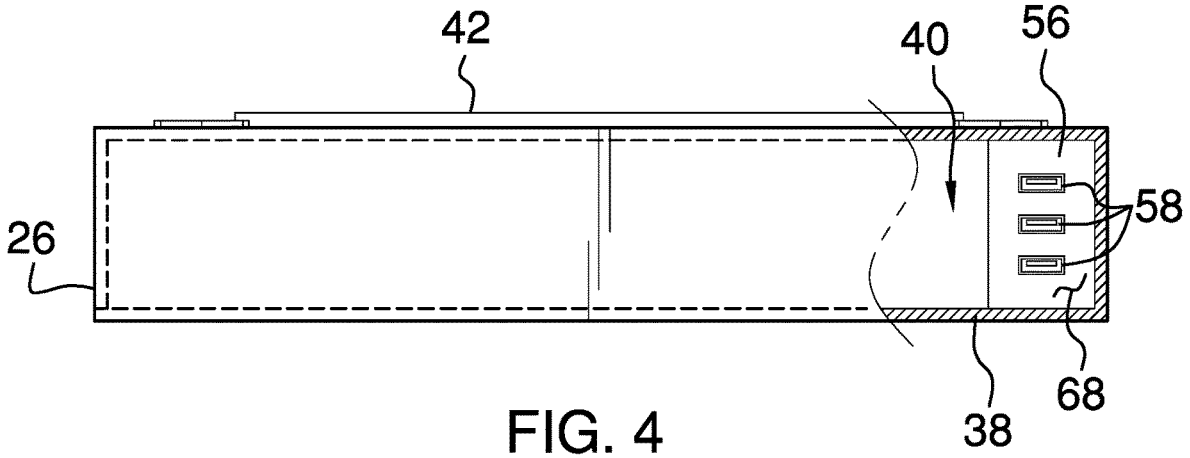
FIG. 4 is a top cut-away view of a box an embodiment of the disclosure.
Figure 5:
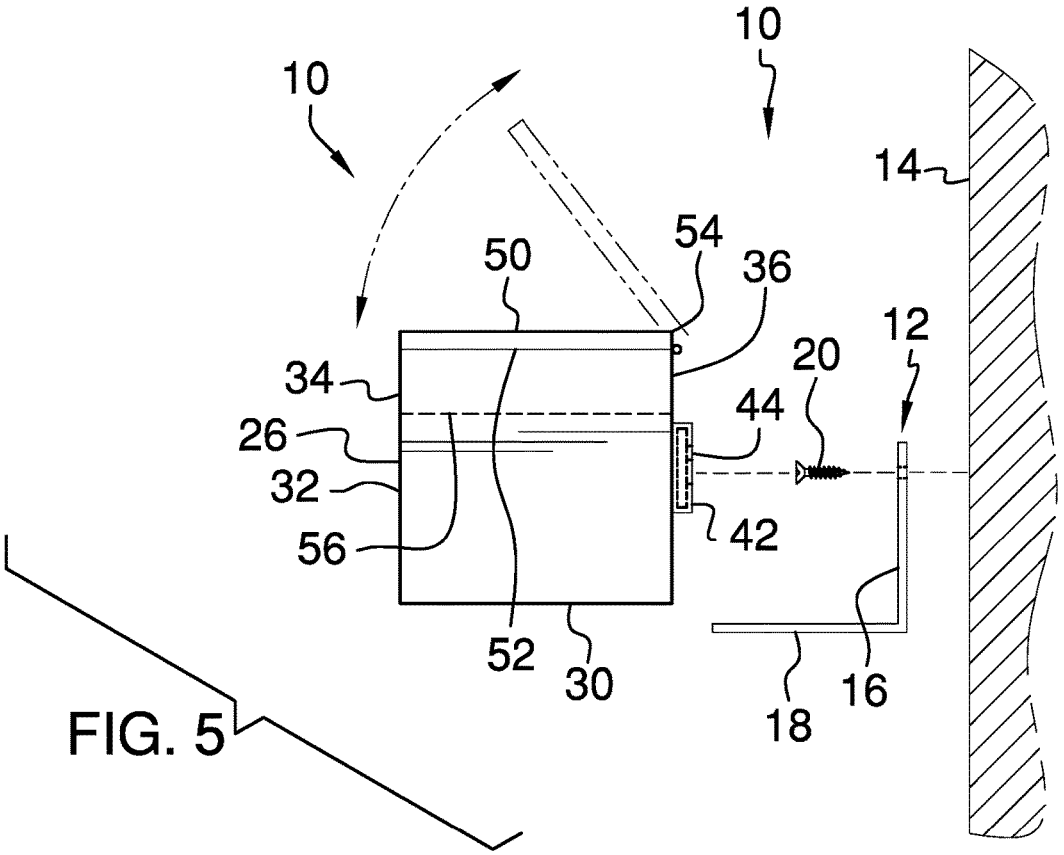
FIG. 5 is an exploded perspective view of an embodiment of the disclosure.

With reference now to the drawings, and in particular to FIGS. 1 through 5 thereof, a new furniture spacing device embodying the principles and concepts of an embodiment of the disclosure and generally designated by the reference numeral 10 will be described.

As best illustrated in FIGS. 1 through 5, the furniture spacing shelf assembly 10 generally comprises a bracket 12 that is attached to a vertical support surface 14, such as a wall in a room of a house. The bracket 12 has a first section 16 forming an angle with a second section 18. The first section 16 is positioned against the vertical support surface 14 having the second section 18 extending laterally away from the vertical support surface 14. A plurality of fasteners 20, such as wood screws or the like, is extended through the first section 16 to engage the vertical support surface 14. The bracket 12 may be positioned at a height that corresponds to the height of a backrest 22 on an article of furniture 24 such as a couch or other article of furniture 24 for sitting.

A box 26 is provided and the box 26 is removably attached to the bracket 12 such that the box 26 is aligned with the backrest 22 of the article of furniture 24. The box 26 has a depth of at least 4.0 inches and the article of furniture 24 abuts the box 26. Thus, the box 26 inhibits the article of furniture 24 that is placed against the box 26 from covering a heating vent 28 that is positioned adjacent to the vertical support surface 14. The box 26 has a bottom wall 30 and an outer wall 32 extending upwardly therefrom, and the outer wall 32 has a front side 34, a back side 36 and a distal edge 38 with respect to the bottom wall 30 defining an opening 40 into the box 26.

The bottom wall 30 rests on the second section 18 of the bracket 12 for supporting the box 26 on the bracket 12. A mount 42 is coupled to the box 26 and the mount 42 engages the fasteners 20 employed to attach the bracket 12 to the vertical support surface 14 for retaining the box 26 on the bracket 12. The mount 42 is positioned on the back side 36 of the outer wall 32 of the box 26 and the mount 42 has a distal wall 44 with respect to the back side 36. Additionally, the distal wall 44 has a plurality of engagements 46 thereon and each of the engagements 46 releasably engages a head 48 of a respective one of the fasteners 20. The mount 42 is oriented to extend along a horizontal axis on the box 26.

A lid 50 is hingedly coupled to the box 26 for opening 40 and closing the box 26. The lid 50 has a lower surface 52 and a back edge 54, and the back edge 54 is hingedly coupled to the back side 36 of the outer wall 32 of the box 26. The lower surface 52 rests on the distal edge 38 of the outer wall 32 of the box 26 when the lid 50 is closed. A power unit 56 is coupled to the box 26 and the power unit 56 has a plurality of outlets 58 therein. Each of the outlets 58 can have an electronic device electrically coupled thereto for charging the electronic device.

The power unit 56 includes a power cord 60 extending away from the bottom wall 30 of the box 26 and the power cord 60 has a distal end 62 with respect to the box 26. A plug 64 is electrically coupled to the distal end 62 and the plug 64 can be electrically coupled to a power source 66 comprising a female electrical outlet. The power unit 56 is attached to the outer wall 32 of the box 26 such that the power unit 56 is positioned inside the box 26. The power unit 56 has an upper surface 68, the upper surface 68 is aligned with the distal edge 38 of the outer wall 32 of the box 26 and each of the outlets 58 is recessed into the upper surface.

In use, the bracket 12 is mounted to the vertical support surface 14 at a height that corresponds to the height of the backrest 22 of the article of furniture 24. Additionally, the bracket 12 is positioned proximate a heater vent in the floor that is positioned adjacent to the vertical support surface 14. The box 26 is positioned on the bracket 12 such that the mount 42 engages the fasteners 20. The article of furniture 24 is positioned against the box 26 and the box 26 inhibits the article of furniture 24 from sliding rearwardly when a person sits on the article of furniture 24. In this way the box 26 ensures that the article of furniture 24 does not obstruct the heating vent 28.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A furniture spacing shelf assembly being configured to be mounted to a vertical support surface thereby inhibiting an article of furniture from being pushed against the vertical support surface, said assembly comprising:

a bracket being configured for attachment to the vertical support surface, said bracket having a first section forming an angle with a second section, said first section being configured for positioning against the vertical support surface having said second section extending laterally away from the vertical support surface;

a box being removably attached to said bracket, said box having a depth of at least 4.0 inches wherein said box is configured to keep an article of furniture that is placed against the box from covering a heating vent that is positioned adjacent to the vertical support surface, said box having a bottom wall and an outer wall extending upwardly therefrom, said outer wall having a front side, a back side and a distal edge with respect to said bottom wall defining an opening into said box, said bottom wall resting on said second section of said bracket for supporting said box on said bracket;

a lid being hingedly coupled to said box for opening and closing said box;

a power unit being coupled to said box, said power unit having a plurality of outlets therein wherein each of said outlets is configured to have an electronic device electrically coupled thereto for charging the electronic device; and a mount being coupled to said box, said mount engaging fasteners employed to attach said bracket to the vertical support surface thereby retaining said box on said bracket, said mount being positioned on said back side of said outer wall of said box, said mount having a distal wall with respect to said back side, said distal wall having a plurality of engagements thereon, each of said engagements releasably engaging a head of a respective one of the fasteners, said mount being oriented to extend along a horizontal axis on said box.

2. The assembly according to claim 1, wherein said lid has a lower surface and a back edge, said back edge being hingedly coupled to said back side of said outer wall of said box, said lower surface resting on said distal edge of said outer wall of said box when said lid is closed.

3. The assembly according to claim 1, wherein:

said power unit includes a power cord extending away from said bottom wall of said box, said power cord having a distal end with respect to said box, said distal end having a plug being electrically coupled thereto, said plug being configured to be electrically coupled to a power source comprising a female electrical outlet; and said power unit is attached to said outer wall of said box having said power unit being positioned inside said box, said power unit having an upper surface, said upper surface being aligned with said distal edge of said outer wall of said box, each of said outlets being recessed into said upper surface.

4. A furniture spacing shelf assembly being configured to be mounted to a vertical support surface thereby inhibiting an article of furniture from being pushed against the vertical support surface, said assembly comprising:

a bracket being configured for attachment to the vertical support surface, said bracket having a first section forming an angle with a second section, said first section being configured for positioning against the vertical support surface having said second section extending laterally away from the vertical support surface;

a box being removably attached to said bracket, said box having a depth of at least 4.0 inches wherein said box is configured to keep an article of furniture that is placed against the box from covering a heating vent that is positioned adjacent to the vertical support surface, said box having a bottom wall and an outer wall extending upwardly therefrom, said outer wall having a front side, a back side and a distal edge with respect to said bottom wall defining an opening into said box, said bottom wall resting on said second section of said bracket for supporting said box on said bracket;

a mount being coupled to said box, said mount engaging fasteners employed to attach said bracket to the vertical support surface thereby retaining said box on said bracket, said mount being positioned on said back side of said outer wall of said box, said mount having a distal wall with respect to said back side, said distal wall having a plurality of engagements thereon, each of said engagements releasably engaging a head of a respective one of the fasteners, said mount being oriented to extend along a horizontal axis on said box;

a lid being hingedly coupled to said box for opening and closing said box, said lid having a lower surface and a back edge, said back edge being hingedly coupled to said back side of said outer wall of said box, said lower surface resting on said distal edge of said outer wall of said box when said lid is closed; and a power unit being coupled to said box, said power unit having a plurality of outlets therein wherein each of said outlets is configured to have an electronic device electrically coupled thereto for charging the electronic device, said power unit including a power cord extending away from said bottom wall of said box, said power cord having a distal end with respect to said box, said distal end having a plug being electrically coupled thereto, said plug being configured to be electrically coupled to a power source comprising a female electrical outlet, said power unit being attached to said outer wall of said box having said power unit being positioned inside said box, said power unit having an upper surface, said upper surface being aligned with said distal edge of said outer wall of said box, each of said outlets being recessed into said upper surface.

* * * * *